US006875097B2

(12) United States Patent
Grunwald

(10) Patent No.: US 6,875,097 B2
(45) Date of Patent: Apr. 5, 2005

(54) FIXED ABRASIVE CMP PAD WITH BUILT-IN ADDITIVES

(75) Inventor: John Grunwald, Ramat-Gan (IL)

(73) Assignee: J. G. Systems, Inc., Miami, FL (US)

( * ) Notice: Subject to any disclaimer, the term of this patent is extended or adjusted under 35 U.S.C. 154(b) by 0 days.

(21) Appl. No.: 10/678,878

(22) Filed: Oct. 3, 2003

(65) Prior Publication Data

US 2004/0235407 A1 Nov. 25, 2004

(30) Foreign Application Priority Data

May 25, 2003 (IL) ..... 156094

(51) Int. Cl.[7] ..... B24D 11/00
(52) U.S. Cl. ..... 451/533; 451/534
(58) Field of Search ..... 451/28, 36, 41, 451/60, 63, 526–539; 438/626–633, 691–693; 51/307–309; 252/79.1, 79.4

(56) References Cited

U.S. PATENT DOCUMENTS

| | | | | |
|---|---|---|---|---|
| 3,533,727 | A | | 10/1970 | Grunwald, et al. |
| 3,567,365 | A | | 3/1971 | Parish |
| 3,567,649 | A | | 3/1971 | Grunwald et al. |
| 5,692,950 | A | | 12/1997 | Rutherford et al. |
| 6,306,012 | B1 | * | 10/2001 | Sabde ..... 451/41 |
| 6,346,032 | B1 | | 2/2002 | Zhang et al. |
| 6,364,749 | B1 | | 4/2002 | Walker |
| 6,395,194 | B1 | * | 5/2002 | Russell et al. ..... 252/79.1 |
| 6,448,182 | B1 | | 9/2002 | Hall et al. |
| 6,527,622 | B1 | * | 3/2003 | Brusic et al. ..... 451/28 |
| 6,730,592 | B2 | * | 5/2004 | Vaartstra ..... 438/633 |
| 2002/0173235 | A1 | | 11/2002 | Koinkar et al. |
| 2002/0177316 | A1 | | 11/2002 | Miller et al. |

FOREIGN PATENT DOCUMENTS

| | | |
|---|---|---|
| WO | WO 01/44396 | 6/2001 |
| WO | WO 02/18099 | 3/2002 |
| WO | WO 02/083804 | 10/2002 |

* cited by examiner

*Primary Examiner*—David B. Thomas
(74) *Attorney, Agent, or Firm*—Carmody & Torrance LLP

(57) ABSTRACT

This invention discloses fixed abrasive chemical mechanical polishing pads, wherein the pad itself comprises at least one material selected from the group consisting of oxidants, wetting agents and other additives normally delivered via a polishing slurry, which assist in the polishing effectiveness of the pad. The improved polishing pad provides both the benefit of a fixed abrasive and the benefits of slurry based polishing systems.

12 Claims, No Drawings

FIXED ABRASIVE CMP PAD WITH BUILT-IN ADDITIVES

FIELD OF INVENTION

The invention relates to wafer planarizing chemical mechanical polishing (CMP) systems.

BACKGROUND OF THE INVENTION

With the growing demand for ever greater miniaturization of ULSI devices, planarization via CMP becomes an increasingly critical aspect in the fabrication sequence of semiconductor devices. The challenge stems, inter alia, from the multitude and differing nature of materials used in the various layers, the demanding geometries and aspect ratios of the structures, the ever present quest for improved IC device flatness and better yields via reduction of defects.

Broadly, there are known two types of CMP compositions and processes:

A. Slurry-based CMP, wherein abrasive particles contained in an aqueous suspension along with a host of other ingredients are delivered onto a pad, typically made of polyurethane, or polyuretahane composites, with the surface to be planarized rubbing against the rotating pad, resulting in levelling action via removal of protruding/uneven matter.

B. "Fixed abrasive" pads, wherein abrasive particles are embedded in a binder, and, as a rule, need not to be delivered, separately. The polishing pad generally constitutes the upper portion of a three layered construction.

The fixed abrasive technology appears to be gaining momentum, for some of the reasons listed below:

1. Slurry-based systems can be prone to inconsistent and uneven slurry distribution across the polishing pad, leading to unsatisfactory planarity in the polished substrate.

2. Slurry suspensions tend to settle and become less than homogeneous, again causing uneven polishing action.

3. Slurry suspensions can clog up delivery ducts and apparatus, requiring somewhat taxing cleaning and maintenance regimes.

4. Surfaces and pores of polishing pads tend to deteriorate as a result of hydrolytic exposure of the polyurethane surface to the slurry suspension, resulting in inconsistent performance.

5. Slurry-based polishing pads and systems tend to generate waste and are less than environmentally friendly.

Above enumerated shortcomings of slurry-based CMP systems, are generally not encountered in fixed abrasive polishing constructions, wherein the abrading layer is encapsulated in a binder, and engineered to achieve maximum flatness, that generally duplicates similar flatness or planarity in the wafer that is to be polished.

However, as is generally the case with technical improvements, some of the benefits of "older, i.e. slurry-based pads and systems, are lost in the fixed abrasive constructions. Still, fixed abrasive, precision-engineered pads and methods are the preferred choice in many instances in operations where maximum planarity is key.

Perhaps the most salient benefit missing in fixed abrasive elements, is that slurry-based compositions can be formulated to contain, in addition to the abrasive particles, other valuable chemical components, such as wetters, oxidants, leveling agents and the like, making the slurry suspension self-sufficient throughout the polishing operation, because the slurry composition contains all that is chemically required for synergistic interaction of mechanical abrasion coupled with chemical interaction at the slurry/wafer interface. Indeed, in the case of fixed abrasive pads on the market today, needed chemicals i.e. oxidants, must be delivered separately.

A. Related Art on Slurry-Based CMP Compositions

Patent applications WO 02/083804 to Costas, US 2002/0177316 A1 to Miller and WO 01/44396 A1 to Sachan, are referenced herewith as indicative of methods and compositions of typical slurry-based CMPs of the prior art. They reflect the differing natures of CMP compositions, dictated by the tasks/problems they need to address, for example nature of the layers, selectivity, surface roughness and throughput.

CMP slurries can be somewhat simplistically described as consisting of abrasive particulate matter suspended in aq., desirably stable, compositions. Such suspensions usually contain a host of additives, pH adjusters, leveling agents, emulsifiers, and the like. In slurry-based CMPs, the slurry is usually dispensed on a rotating pad in contact with a rotating wafer. Planarization is said to involve a combination of abrasion, as well as chemical reaction at the wafer/slurry interface.

A significant, and generally central component of various slurry-based chemical mechanical polishing systems, is the oxidizing agent, typically $H_2O_2$. The choice of the oxidizing agent is usually tailored to suit a given substrate to be polished, with copper perhaps being the most challenging, as it is becoming the metal of choice for interconnect applications, due to its superior electrical conductivity.

While hydrogen peroxide is an attractive oxidizing agent at reasonable cost, it is not without some serious drawbacks, namely poor stability, especially in the presence of transition metals that are known to catalyze decomposition. Another shortcoming of $H_2O_2$ is its less than ideal selectivity. Further, the reaction of peroxides during dissolution of copper, is highly exothermic, making it problematic to maintain temperature stability at the copper/slurry interface, where polishing takes place.

U.S. Pat. No. 6,448,182 to Hall addresses the stability issue of $H_2O_2$ through incorporation of stabilizers that are intended to reduce, but will not eliminate, decomposition.

CMP is said to be effected by a dual, said to be synergistic, mechanical/chemical process. The mechanical aspect is obtained by applying downward pressure, with the abrasive in the slurry removing unwanted surface material. As such, the mechanism of the abrasive action is relatively simple and fairly well understood. On the other hand, the chemical mechanism of CMP is more complex, and its interaction with the mechanical component of CMP has yet to be fully understood, namely as to how it participates in promoting the desired final surface finish, namely smoothness, specularity, freedom from oxides, and the like. In the case of copper conductors, the chemical aspect of CMP is significant, indeed. Hence, the crucial importance of oxidants.

B. Related Art on Fixed Abrasive Pads

Reference is made to U.S. Pat. No. 5,692,950 to Rutherford, disclosing a fixed abrasive polishing construction, and a method to manufacture it, as detailed in Example 1 of the disclosure. It is noted that the fixed abrasive layer, the one that effects grinding or material removal, is produced by blending a slurry comprising cerium oxide and calcium carbonate, with acrylates, plasticizers, coupling agents, photoinitiators, etc. This abrasive layer constitutes the abrading, upper portion of the fixed abrasive assembly. There is no apparent provision in the disclosure as to the method of using the fixed abrasive structure, especially as to whether it is to be used as is, or if polishing is assisted by fluid being dispensed to the pad/wafer interface during abrasion.

U.S. Pat. No. 6,346,032 to Zhang discloses a fluid dispensing arrangement designed to deliver a "variety of fluids" that assist in the polishing process of fixed abrasive polishing pad, and/or waste particle removal from the surface to be polished.

Published PCT application # WO 02/18099 A2 to Chopra, has provision to deliver oxidizing solutions, with or without slurry, to the fixed abrasive pad/wafer interface in order to assist with metals, especially copper, and the barrier layer such as tungsten. Hydrogen peroxide is apparently preferred for copper.

U.S. Pat. No. 6,364,749 to Walker, addresses wetting problems associated with fixed abrasion assemblies, specifically with the outer surface of protruding abrasive particles that are encapsulated in a hydrophobic resin. It is not completely understood how wetting can be preserved as the outer layer of the pad is undergoing wear during polishing.

SUMMARY OF THE INVENTION

The invention envisions fixed abrasive polishing pads, wherein some of the needed chemical compounds contained in CMP slurry suspensions, are incorporated in the fixed abrasive polishing pad, along with the abrasive particles, thereby reducing their needed delivery from without. In other words, the invention affords more self-contained, more self-sufficient fixed abrasive polishing pads. While ideally one would want a fixed abrasive polishing pad that incorporates all the necessary chemicals that are normally formulated into slurry suspensions, with only water to be dispensed to the dry, fixed abrasive polishing pads, it is appreciated that at this time not all such needed additives can be made an integral part of the abrading structure of fixed abrasive pads.

The invention thus provides an abrasive construction for use in chemical mechanical polishing of a substrate including at least one conducting or semiconducting layer, wherein the abrasive construction comprises at least one abrasion-effective layer adapted to remove at least a portion of the conducting or semiconducting layer from the substrate, the abrasion-effective layer comprising at least one oxidant selected from halogen derivative, dissolved oxygen, organic nitro derivatives and mixtures thereof.

It is a preferred embodiment of the invention to include oxidizing chemical or chemicals in the abrasion-effecting layer of the fixed abrasion element.

A further embodiment of the invention envisions fixed abrasive pads with enhanced hydrophilic behavior, as a result of inclusion of wetting—promoting, or hygroscopic particles into the abrading layer of the fixed abrasive pad.

DETAILED DESCRIPTION OF THE INVENTION

The embodiment of the invention that calls for imparting oxidizing properties to the fixed abrasive pad, contemplates blending solid oxidizers with the other constituents of the polishing layer, such as abrasive particles, binders, etc., following possibly methods similar to the procedure outlined in Example 1 of U.S. Pat. No. 5,692,950, referenced previously.

In proposing oxidizing chemicals suitable for the present invention, reference is made to pending IL applications No. 154782, 154783 and 15554, disclosing oxidizers for CMP slurry-based compositions. Of principal interest in above-referenced pending IL applications for this invention, are oxidizers in the category of organic nitro derivatives, and particularly aromatic nitro derivatives, such as m-nitro benzene sulfonic acid, m-nitro benzoic acids, or salts thereof. Indeed, above aromatic nitro derivatives are somewhat unique, as they are thermally stable, their applicability encompasses a variety of metals, at both acid and alkaline pHs. Such features are quite attractive, as said organic nitro derivatives allow optimum flexibility for the fixed abrasive pad. Indeed, one skilled in the art will appreciate their "multi purpose" possibilities, as they afford tailoring a metal etching or metal polishing task to accommodate a given metal, simply by optimizing the pH of the aqueous solution delivered to the oxidant-bearing fixed abrasive pad, as it rubs against the wafer surface to be polished.

Also, while above aromatic nitro derivatives of this invention principally act as oxidants, they can also contribute to improved wetting of the fixed abrasive pad, as their sulfonate or benzoate salts are quite hydrophilic.

Another group of attractive oxidants for the scope of this invention, is taken from the group of halogen derivatives, copper oxides and cupric/cuprous salts. They too, can be admixed with other ingredients in the fixed abrasion pad, acting as in-situ etchants/oxidants for a variety of metals, and potentially serve at the same time as auxiliary, mild abrasives. As to cuprous oxides/salts vs. their cupric counterparts, they are fairly unstable and will be oxidized by air ($O_2$).

In choosing oxidizers or other potentially helpful ingredients to be incorporated in the outer, abrasion-effecting outer pad, beyond the constituents of the prior art, as exemplified in part by above referenced fixed abrasive patents, one is helpfully guided by the following:

1. The ingredient/additives to be blended with, and into the polishing layer, is preferably a solid at ambient temperature.

2. The ingredient/additive needs to be of reasonable thermal stability. This is of special significance for oxidants, as they can pose safety hazards, during blending or during polishing.

3. The blended-in ingredients/additives should easily be solubilized, leached out from the polishing pad by the solution or water that is dispensed At the polishing pad/wafer interface, so as to become available in-situ to effect the desired chemical reaction on the polished wafer.

The patent further envisions conditioning or preconditioning of the solid abrasive pad, so as to expose/bare the chemical additives, i.e. oxidants, by at least partially removing the polymer that encapsulates them.

In one such embodiment, conditioning/preconditioning is accomplished chemically, as opposed to mechanically, through contact with an organic solvent, or preferably through contact with an emulsion, or better yet, with a microemulsion. US #2002/0173235 to Koinkar is cited here, as potentially helpful in generally addressing breaking-in and conditioning fixed abrasive pads. As to the general art of emulsions/microemulsions, one will be aided by a publication entitled "Microemulsions and emulsions in foods", ACS Symposium Series 448, El-Nokaly and Cornell, Apr. 22–27, 1990. Also referenced herewith are U.S. Pat. Nos. 3,533,727, 3,567,649 and 3,567,365 as potentially beneficial in addressing emulsions as the fluid of choice to be dispensed at the pad/wafer interface.

Regarding quantities of the additives, i.e. oxidants, to be included in the outer, abrasion-effecting pad of the fixed abrasive structures, they can vary from the range of about several ppm levels of the slurry, to about 1–100 parts of the slurry or even higher, and will be best optimized by trial-and-error.

As to types of oxidants, while the patent embodies incorporating at least one, it also visualizes incorporation of a mixture of oxidants. For example, it is within the scope of the invention to include an aromatic m-nitro sulfonic acid or a salt thereof, along with copper oxides and cupric/cuprous salts, i.e. copper chloride, sulfate, nitrate, carbonate, etc. Also, one can opt for a combination of nitro aromatic derivatives, i.e. m-nitro benzene sulfonic acid and m-nitro benzoic acid, or salts thereof.

Above teachings of embedding several, differing oxidants in the slurry, can lead to multi-purpose polishing pads, namely pads that can address a variety of substrates, materials and metals, by varying the pH or the general composition of the aqueous solution, preferably emulsion, to be dispensed at the polishing pad/wafer interface to accommodate a given need.

This concept of multiple types of additives, may also be of great benefit when including wetting-promoting compounds to the slurry, as envisioned by the patent.

What is claimed is:

1. A polishing pad for use in chemical mechanical polishing of a substrate, said substrate comprising at least one conducting or semi-conducting layer, said polishing pad comprising:

a) binder, b) abrasive particles; and c) at least one oxidant selected from the group consisting of organic nitro compounds, copper oxides and copper salts;

wherein the polishing pad is adapted to remove at least a portion of the conducting or semi-conducting layer from the substrate.

2. A polishing pad according to claim 1 wherein the polishing pad also comprises a surfactant.

3. A polishing pad according to claim 1 wherein the polishing pad also comprises a complexing agent.

4. A polishing pad according to claim 1 wherein the polishing pad comprises multiple layers.

5. A polishing pad according to claim 1 wherein the oxidant comprises an aromatic nitro compound.

6. A polishing pad according to claim 1 wherein the oxidant comprises a material selected from the group consisting of m-nitro benzene sulfonic acid and salts of the foregoing.

7. A method of polishing a substrate, said substrate comprising at least one conducting or semi-conducting layer, said method comprising contacting the substrate with a polishing pad comprising:

a) binder;

b) abrasive particles; and c) at least one oxidant selected from the group consisting of organic nitro compounds, copper oxides and copper salts;

wherein the polishing pad is move in relation to the substrate and wherein at least a portion of the conducting or semi-conducting layer is removed from the substrate.

8. A method according to claim 7 wherein the polishing pad also comprises a surfactant.

9. A method according to claim 7 wherein the polishing pad also comprises a complexing agent.

10. A method according to claim 7 wherein the polishing pad comprises multiple layers.

11. A method according to claim 7 wherein the oxidant comprises an aromatic nitro compound.

12. A method according to claim 7 wherein the oxidant comprises a material selected from the group consisting of m-nitro benzene sulfonic acid and salts of the foregoing.

* * * * *